US005826490A

United States Patent [19]

Madsen et al.

[11] Patent Number: 5,826,490

[45] Date of Patent: Oct. 27, 1998

[54] COMPRESSOR, IN PARTICULAR FOR AIR-CONDITIONING SYSTEMS IN VEHICLES

[75] Inventors: Per Johan Madsen, Nordborg; Harry Stentoft Nissen, Sønderborg; Jens Simonsen; Stig Helmer Jørgensen, both of Nordborg; Jørgen Holst, Sydals, all of Denmark

[73] Assignee: Danfoss A/S, Nordborg, Denmark

[21] Appl. No.: 859,991

[22] Filed: May 21, 1997

[30] Foreign Application Priority Data

May 24, 1996 [DE] Germany ..... 196 21 174.3

[51] Int. Cl.[6] ..... F01B 3/00

[52] U.S. Cl. ..... 92/71; 92/165 PR; 417/269; 74/60

[58] Field of Search ..... 92/12.2, 71, 165 R, 92/165 PR; 417/269, 222.1, 222.2; 74/60; 91/499

[56] References Cited

U.S. PATENT DOCUMENTS

| | | | |
|---|---|---|---|
| 970,640 | 9/1910 | McClintock | 74/60 |
| 3,255,638 | 6/1966 | Livers | 74/60 |
| 4,275,998 | 6/1981 | Petersson | 417/269 |
| 5,038,673 | 8/1991 | Schultze | 91/499 |
| 5,174,728 | 12/1992 | Kimura et al. | 417/222.2 |
| 5,269,193 | 12/1993 | Rabinow | 92/71 |
| 5,490,444 | 2/1996 | Claas | 417/269 |
| 5,490,767 | 2/1996 | Kannou et al. | 417/222.1 |

*Primary Examiner*—Thomas E. Denion

*Attorney, Agent, or Firm*—Lee, Mann, Smith, McWilliams, Sweeney & Ohlson

[57] ABSTRACT

A compressor is disclosed, in particular for air-conditioning systems in vehicles, having at least one piston movable in a cylinder, a drive shaft and a wobble plate arrangement between the piston and the drive shaft. To improve the efficiency and to reduce leaks, the wobble plate arrangement comprises a swash plate, on which a wobble plate is rotatably mounted. Between the wobble plate and the piston is arranged a bearing which allows movement of the wobble plate relative to the piston in the circumferential direction.

16 Claims, 1 Drawing Sheet

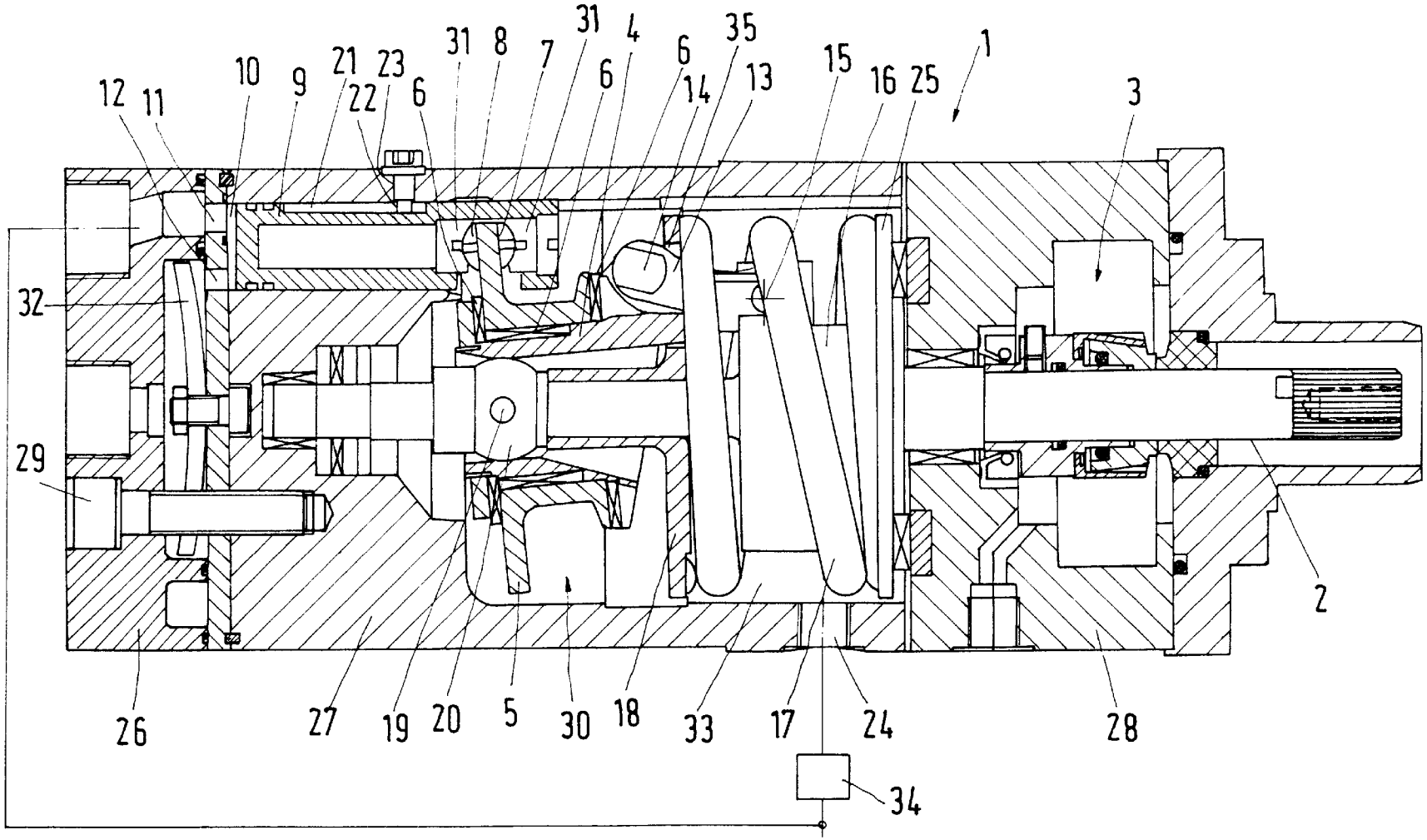
1
2
3
4
5
6
6
6
7
8
9
10
11
12
13
14
15
16
17
18
19
20
21
22
23
24
25
26
27
28
29
30
31
31
32
33
34
35

COMPRESSOR, IN PARTICULAR FOR AIR-CONDITIONING SYSTEMS IN VEHICLES

BACKGROUND OF THE INVENTION

The invention relates to a compressor, in particular for air-conditioning systems in vehicles. Such compressors operate in many cases according to the axial piston principle, that is, they have a housing in which a rotatable drive shaft is mounted. The drive shaft is connected to a swash plate. When the drive shaft rotates, the swash plate or, as required, a wobble plate connected thereto, is caused to perform a wobbling movement. This wobbling movement is used to move at least one piston back and forth in a cylinder, which is provided in the housing. Normally, however, such a compressor has several pistons with corresponding cylinders.

Compressors of that kind have already been described many times. Thus, U.S. Pat. Nos. 5,407,328, 5,056,416, 5,059,097 and 5,425,303 describe such compressors, in which a wobble plate is mounted rotatably on the swash plate. The wobble plate is prevented by different means from co-rotating with the rotating plate. It can therefore be fixedly connected to the pistons, in which case only articulated arrangements need to be provided in order to allow a change in the inclination of the swash plate. This allows the output capacity of the compressor to be changed via a change in the stroke of the pistons. Because of the change in inclination, the pistons are connected to the wobble plate by means of a rod, which has a spherical head at each end. These rods compensate for the different radii of application of the axial forces which occur on change in the inclined position of the swash plate. Since the rods are able to transmit forces only in their longitudinal direction, however, an uneven loading on the pistons occurs if the rods do not move exactly parallel to the longitudinal direction of the piston movement. This gives rise on the one hand to leaks, and on the other hand the friction between pistons and cylinders increases. The wobble plate has to be mounted on the swash plate within these points of application of the rods. As a consequence, either the diameter of such a compressor becomes comparatively large, or the bearing of the wobble plate on the swash plate has to be kept small. In the latter case, relatively large frictional forces occur, which reduce the efficiency of such a compressor because the swash plate rotates at the speed of the drive shaft with respect to the wobble plate. Since the wobble plate has to be secured against rotation, for which purpose a torque arm is needed, the diameter becomes larger.

A different construction of compressors is described in U.S. Pat. Nos. 5,417,552 and 5,387,091. Here, no separation between swash plate and wobble plate is provided. In return the swash plate is connected directly with the pistons by way of sliding arrangements, that is, a relative movement in the circumferential direction between swash plate and the pistons is possible. Since the pistons bear relatively far towards the outside on the swash plate, relatively large speeds in the circumferential direction occur here, which in turn increases friction. The frictional forces engage the pistons with a relatively large leverage and press them in the circumferential direction against the cylinder wall. This leads to greater wear and again reduces efficiency.

SUMMARY OF THE INVENTION

The invention is based on the problem of providing a compact compressor with low wear in operation.

That problem is solved by a compressor, in particular for air-conditioning systems in vehicles, having at least one piston movable in a cylinder, a drive shaft and a wobble plate arrangement between the piston and the drive shaft, wherein this wobble plate arrangement comprises a swash plate, on which a wobble plate is rotatably mounted, and between the wobble plate and the piston is arranged a bearing which allows movement of the wobble plate relative to the piston in the circumferential direction.

By means of this arrangement the number of degrees of freedom in the movement of the wobble plate is increased. The wobble plate is able to rotate freely both with respect to the swash plate and with respect to the piston or pistons. Only the wobbling movement, which is necessary for producing the desired piston movement, is defined. Because of the additional degree of freedom, the rotational speed of the wobble plate with respect to the swash plate and the pistons will adjust so that friction is at its lowest. The forces that are exerted by the wobble plate on the piston are then likewise minimal, so that lop-sided loading of the fit between pistons and cylinders is likewise minimised. Since the frictional forces and therefore also the transverse forces on the piston or pistons are kept small, not only is efficiency high, but wear is also low. Since no torque arm is needed for the wobble plate, which would prevent it from rotating, external dimensions remain small.

The bearing preferably allows movement also between wobble plate and piston in the radial direction. When the inclination of the swash plate changes, the piston is able to shift its point of application on the wobble plate. By a change in the inclination of the swash plate, no additional forces therefore occur in the radial direction between piston and cylinder. The freedom of the piston to shift with respect to the wobble plate moreover has the advantage that the forces resulting from the inclination effective between the piston and the wobble plate counteract in the bearing the centrifugal forces that occur.

The bearing is preferably in the form of a slider shoe arrangement which bears, on both axial sides with a smooth sliding surface, against the wobble plate. The desired play between the wobble plate and the piston is thus ensured in a simple manner.

The slider shoe arrangement preferably has a pair of spherical slider shoes for each piston, which shoes are swivel-mounted in corresponding recesses of the piston. In an extreme case the pair of slider shoes can therefore comprise a sphere divided into two, which is inserted in a correspondingly spherical socket, the wobble plate being received between the two halves of the sphere. The sphere does not need to be a complete sphere, of course. The size of the spherical portion is determined by the desired angle through which the swash plate can be swivelled.

The drive shaft is advantageously connected to a base plate so that they rotate together, the base plate being connected by way of an articulated arm to the swash plate so that they rotate together, the articulated arm forming thereby a displaceable swivel point for the swash plate. The articulated arm therefore has two functions. Firstly, it transfers the rotary movement from the drive shaft to the swash plate. Secondly, it defines a point about which the swash plate can be swivelled when the angle of the swash plate relative to the drive shaft changes. The swivel point need not be a fixed point on the articulated arm. The articulated arm can also have several articulations.

A spring is preferably arranged between the base plate and the swash plate, which spring acts on the swash plate in the direction of minimal displacement. This spring therefore presses or pulls the swash plate into a position in which the angle between the swash plate and the drive shaft lies in the region of nearly 90°. At such an angle setting, the piston stroke is minimal. When the compressor is required to convey refrigerant, this angle setting of the swash plate has to be changed. At least during start-up of the compressor, however, the neutral setting induced by the spring can be maintained, which facilitates start-up operation.

Between the spring and the swash plate there is preferably arranged a pressure plate which together with the swash plate is displaceable axially on the drive shaft. Defined force ratios for the spring are therefore created. The face of the pressure plate to which pressure is applied can extend substantially perpendicular to the drive shaft, so that the spring does not have to exert lopsided forces which would lead to greater wear. Since, on the other hand, the pressure plate can be moved jointly with the swash plate on the drive shaft, the desired behaviour of the swash plate can be adjusted.

The pressure plate preferably has a through-opening through which the articulated arm passes. The pressure plate can therefore have a relatively large diameter without, incidentally, the ability of the compressor to function being influenced, and particularly without the diameter of the compressor being increased to an unreasonable size.

In particular, it is in this way possible to construct the spring as a compression spring which is arranged radially outside the articulated arm. The spring can therefore be made relatively large so that it is able to produce correspondingly large forces. At the same time, there is a relatively free choice in the matter of dimensions as regards the remaining construction of the compressor.

The spring preferably surrounds the drive shaft coaxially. This too is a measure to keep the pressure loading on components as uniform as possible. All the forces that are generated by the spring between the base plate and the pressure plate then run virtually parallel to the axis of the drive shaft.

In an especially preferred practical form, provision is made for each piston to be movable in respect of part of its length out of the cylinder into an inner chamber of the housing which has a controllable pressure outlet. With reasonable expense it is virtually impossible to ensure that the fit between the piston and its cylinder is absolutely sealed. Refrigerant will therefore always escape from between the piston and the cylinder. In the present case, however, the refrigerant will then be caught in the inner chamber of the housing. The regular incoming flow of refrigerant into the housing inner chamber then leads to a change in pressure, in particular to an increase in pressure in the inner chamber of the housing. This pressure increase can then be utilised to control the inclination of the swash plate as is known Per se. The pressure in the housing inner chamber can be controlled by means of the controllable pressure outlet.

Particularly when the pressure output is loadable with suction pressure of the compressor, the pressure in the housing inner chamber can drop to such an extent that the maximum output capacity of the compressor is reached, in that the swash plate assumes its position of greatest inclination. In that case the stroke of the piston is at its greatest.

In this connection it is especially preferred for the spring to be arranged inside the housing. All the forces that could result in adjustment of the inclined position or of the angle of the swash plate are therefore concentrated in one space. Measures for transfer of these forces to the point of application on the swash plate are unnecessary.

Each piston preferably has in its circumferential surface at least one axially running groove in which a pin projecting radially inwards from the cylinder wall engages. By this means the piston is held, so that it does not rotate, in the cylinder. The movements of the piston in the cylinder therefore remain restricted to the axial direction. Additional frictional forces do not then occur. The piston can retract in the cylinder in a specific position. This increases the service life and reduces leaks.

The pin is in this case preferably arranged on the radially outer side of the compressor housing. This facilitates manufacture.

This is especially advantageous if the pin projects from the outside through the housing. In that case, all that is required is to make a bore on the radially outer side of the housing of the compressor through which the pin can be introduced until it projects into the cylinder. If required the pin can be arranged to be displaceable radially, so that certain adaptations can be made to the individual pistons. It is merely necessary to seal the pin with respect to the housing, but this is relatively easy because the pin is not a moving part as such.

BRIEF DESCRIPTION OF THE DRAWINGS

The invention is described in the following with reference to a preferred exemplary embodiment in conjunction with the drawings, in which the single FIGURE shows a diagrammatic cross-section through a compressor.

DESCRIPTION OF AN EXAMPLE EMBODYING THE BEST MODE OF THE INVENTION

A compressor 1 has a drive shaft 2. For that reason it can also be termed a shaft-driven compressor. The drive shaft 2 is guided through a shaft bushing 3 into a housing, which consists of a front part 26, a middle part 27 and a rear part 28. The housing parts 26, 27, 28 are joined to one another in an axial direction by known means, for example, by threaded bolts 29.

In the middle part 27 of the housing several cylinders 10 are arranged distributed around the circumference, only one of which cylinders is illustrated. In each cylinder 10 there is a piston 9 which is movable back and forth axially.

The drive of the piston 9 or pistons 9 is effected via a wobble plate arrangement 30. The wobble plate arrangement 30 comprises a wobble plate 5 which is rotatably mounted on a swash plate 4. For that purpose, needle roller bearings 6 or other friction-reducing bearings are provided between the wobble plate 5 and swash plate 4.

The wobble plate 5 in its turn is connected by way of sliding bearings 7 to the piston 9. The sliding bearings 7 have hemispherical slider shoes 8 which lie in front of and behind, that is, axially from both sides, on the wobble plate. The slider shoes 8 are received in correspondingly complementarily formed bearing shells 31 which again are fixed in the piston 9.

On the one hand, the sliding bearing 7 enables the wobble plate 5 to rotate freely in relation to the piston 9. On the other hand, however, the radial alignment of the wobble plate 5 with respect to the piston 9 is able to vary. This means, for example, that when the inclination of the swash plate 4 changes, the wobble plate 5 acts radially further outwards or further inwards in relation to the piston 9. In the position of the swash plate 4 illustrated, the wobble plate is located radially relatively far outwards. When the angle between the swash plate 4 and the drive shaft 2 enlarges, the wobble plate 5, with its sliding surface, moves back correspondingly further radially inwards. Thus, the pistons 9 can always be loaded with a force that is applied substantially parallel to their direction of movement.

In a manner known per se, the cylinder 10 has a suction valve opening 11 through which a coolant can be sucked. Furthermore, a pressure valve opening 12 is provided through which refrigerant under pressure can be discharged from the cylinder. The pressure valve opening 12 can be closed by a valve element 32. Corresponding valves for the suction valve opening 11 are not shown here but are provided as needed.

To drive the swash plate 4, a base plate 16 is connected to the drive shaft 2 so that they rotate together. An articulated arm 13 is connected to the base plate 16 so that they rotate together. As the base plate 16 rotates, the articulated arm 13 therefore also rotates. The swash plate 4 is connected to the articulated arm 13 at a swivel point 14, that is, it can be swivelled about this swivel point 14. The articulated arm 13 in turn is connected to the base plate 16, again by a swivel point 15. Thus, as the swash plate 4 swivels, certain changes in the lever geometry formed by the articulated arm 13 can be accommodated in the radial direction. The swivel point of the swash plate can therefore move within certain limits.

A flange 25 is arranged on the base plate 16 and is secured thereto so that they rotate together. A pressure plate 18 is arranged on the drive shaft 2 so as to be displaceable axially. Between the pressure plate 18 and the flange 25 there is a compression spring 17. The compression spring 17 presses the pressure plate forwards, that is, to the left in the FIGURE, and thus pushes the swash plate 4 likewise in that direction. As the swash plate 4 is joined to the base plate 16 via the articulated arm 13, this leads to the swash plate assuming a small inclination so that the piston 9 performs a correspondingly small stroke.

For that purpose the swash plate 4 is able not only to swivel about its swivel point, but also to rotate about a swivel point 19 of a guide arrangement 20 which is displaceable axially on the drive shaft 2 together with the pressure plate 18.

The pressure plate 18 has a through opening 35 through which the articulated arm 13 passes. The compression spring 17 has a relatively large diameter, that is, it surrounds the drive shaft 2 coaxially and can additionally also surround the articulated arm 13 on the outside thereof. Pressure loading relatively far outwards on the pressure plate 18 is therefore possible, without the function of the articulated arm 13 being adversely affected by the compression spring 17. This has a correspondingly favourable effect on the dimensioning of the compression spring 17 and on the overall size of the compressor.

The piston 9 is provided on its circumferential surface with a groove 21. Projecting into the groove 21 is a pin 22, which is formed, for example, by the end of a screw 23 which has been screwed in radially from the outside through the middle part 27 of the housing. The pin 21, together with the groove 21, forms a means safeguarding the piston 9 against rotation.

In its back and forth movement, the piston 9 is pulled a little way into an inner chamber 33 in the housing. It is here virtually inevitable that a small amount of refrigerant, in particular gaseous refrigerant, will escape or leak into the inner chamber 33 of the housing. This constant inflow of refrigerant leads to an increase in the pressure in the housing inner chamber 33. To relieve this pressure, an opening 24 is provided, which is connected to a valve 34, illustrated diagrammatically. By means of the valve 34, the pressure in the housing inner chamber can be reduced. The other side of the valve can be connected, for example, to the suction valve opening 11, so that the pressure in the housing inner chamber 33 can be reduced at most to the suction pressure of the compressor.

By means of the pressure in the housing inner chamber 33, it is possible, for example, to control the inclined position of the swash plate 4 and thus the output capacity of the compressor 1. When the pressure in the housing inner chamber 33 is the same as or approximately the same as the pressure at the pressure valve opening, the two ends of the piston 9 are virtually in equilibrium. In that case, only small reaction forces act on the swash plate 4, so that the compression spring 17 moves the swash plate 4 into the position illustrated in the FIGURE. If, on the other hand, the pressure in the housing inner chamber 33 is lowered, larger forces act against the spring 17 so that the inclination of the swash plate is increased.

The compressor operates as follows:

When the drive shaft 2 is rotated, the base plate 16 rotates with it. The base plate 16 carries with it via the articulated arm 13 the swash plate 4. This sets the wobble plate 5 in a wobbling motion so that the piston 9 is moved back and forth. Depending on the pressure in the housing inner chamber 33, the swash plate 4 is inclined to a greater or lesser extent by the corresponding reaction forces.

By changing the inclination of the swash plate 4, the position of the wobble plate 5 with respect to the sliding bearing 7 also changes, that is, the sliding bearing 7 between the wobble plate 5 and the piston 9 is located radially to a greater or lesser degree towards the outside on the wobble plate. A position obtains in which the forces are lowest.

The wobble plate 5 can continue to rotate freely in relation to the piston 9. It can also rotate freely in relation to the swash plate 4, so that a rotary speed of the wobble plate 5 will occur at which the frictional forces occurring are at their lowest. In this manner it is possible for the compressor 1 to operate with relatively high efficiency and relatively little wear. The forces on the piston 9 are restricted virtually exclusively to the axial direction, so that tilting of the piston 9 with respect to the cylinder 10 is avoided. Wear remains low and the tight seal of the compressor 1 remains correspondingly good.

We claim:

1. Compressor for air-conditioning systems, having at least one piston movable in a cylinder, a drive shaft and a wobble plate arrangement between the piston and the drive shaft, wherein the wobble plate arrangement comprises a swash plate on which a wobble plate is rotatably mounted, and a bearing mounted in the piston, the wobble plate extending into the bearing to allow movement of the wobble plate relative to the piston in the circumferential direction.

2. Compressor according to claim 1, characterized in that the bearing also allows movement also between wobble plate and piston in the radial direction.

3. Compressor according to claim 1, characterized in that the bearing is in the form of a slider shoe arrangement which bears, on both axial sides with a smooth sliding surface, against the wobble plate.

4. Compressor according to claim 3, characterized in that the slider shoe arrangement has a pair of spherical slider shoes for each piston, which shoes are swivel-mounted in corresponding recesses of the piston.

5. Compressor according to claim 1, characterized in that the drive shaft is connected to a base plate so that they rotate together, the base plate being connected by way of an articulated arm to the swash plate so that they rotate together, the articulated arm forming thereby a displaceable swivel point for the swash plate.

6. Compressor according to claim 5, characterized in that a spring is arranged between the base plate and the swash plate, which spring acts on the swash plate in the direction of minimal displacement.

7. Compressor according to claim 6, characterized in that between the spring and the swash plate there is arranged a pressure plate, which together with the swash plate is displaceable axially on the drive shaft.

8. Compressor according to claim 7, characterized in that the pressure plate has a through-opening through which the articulated arm passes.

9. Compressor according to claim 8, characterized in that the spring is in the form of a compression spring which is arranged radially outside the articulated arm.

10. Compressor according to claim 9, characterized in that the spring surrounds the drive shaft coaxially.

11. Compressor according to claim 1, characterized in that each piston is movable in respect of part of its length out of the cylinder into an inner chamber of the housing which has a controllable pressure outlet.

12. Compressor according to claim 11, characterized in that the pressure output is loadable with suction pressure of the compressor.

13. Compressor according to claim 11, characterized in that a spring is arranged in the housing inner chamber.

14. Compressor according to claim 1, characterized in that each piston has in its circumferential surface at least one axially running groove in which a pin projecting radially inwards from the cylinder wall engages.

15. Compressor according to claim 14, characterized in that the pin is arranged on the radially outer side of the compressor housing.

16. Compressor according to claim 15, characterized in that the pin projects from the outside through the housing.

* * * * *